US006058724A

United States Patent [19]

Park

[11] Patent Number: 6,058,724

[45] Date of Patent: May 9, 2000

[54] REFRIGERATOR DEFROST CONTROLLING METHOD

[75] Inventor: Eun Kyung Park, Incheon, Rep. of Korea

[73] Assignee: Daewoo Electronics Co., Ltd., Seoul, Rep. of Korea

[21] Appl. No.: 09/261,507

[22] Filed: Mar. 3, 1999

[30] Foreign Application Priority Data

Aug. 31, 1998 [KR] Rep. of Korea ..... 8-35726

[51] Int. Cl.[7] ..... F25B 47/02

[52] U.S. Cl. ..... 62/156; 62/153; 62/154; 62/155

[58] Field of Search ..... 62/151, 152, 153, 62/154, 155, 156, 234, 80, 81, 82

[56] References Cited

U.S. PATENT DOCUMENTS 4,432,211 2/1984 Oishi et al. ..... 62/155
4,689,965 9/1987 Janke et al. ..... 62/156 X
4,916,912 4/1990 Levine et al. ..... 62/156 X
4,932,217 6/1990 Meyer ..... 62/156

*Primary Examiner*—Harry B. Tanner
*Attorney, Agent, or Firm*—Pillsbury Madison & Sutro LLP

[57] ABSTRACT

A refrigerator defrost controlling method includes the step of setting an initial defrost cycle, the step of determining whether defrost entering conditions are met, the step of driving a defrost heater to remove the frost formed on the evaporator if the defrost entering conditions are met, and setting a defrost restoration temperature and a defrost cycle according to a latent heat period detected by the temperature of a defrost sensor to perform the defrost operation, the step of terminating the operation if the temperature of the defrost sensor reaches the defrost restoration temperature, and the step of resetting a defrost cycle according to the operating rate of a compressor and the number of door opening/closing times if the defrost entering conditions are not met. The amount of the frost formed on the evaporator is determined from the latent heat period obtained by a change in temperature of a defrost sensor, and a defrost restoration temperature and a defrost cycle are adaptively reset accordingly, thereby performing the optimal defrost operation according to the amount of the formed frost.

5 Claims, 6 Drawing Sheets

REFRIGERATOR DEFROST CONTROLLING METHOD

BACKGROUND OF THE INVENTION

1. Field of the Invention

The present invention relates to a refrigerator defrost controlling method, and more particularly, to a refrigerator defrost controlling method for adjusting a defrost cycle and a defrost restoration temperature by detecting a latent heat period obtained by a change in temperatures of a defrost sensor.

2. Description of the Related Art

Generally, a refrigerator repeatedly executes a cooling cycle comprised of compression, condensation, expansion and evaporation of a refrigerant, so that a high-temperature refrigerant gas discharged from a compressor is formed on an evaporator to then generate frost. To overcome such a problem, conventionally, the frost formed on the evaporator is removed by detecting the number of rotations of a fan motor in the refrigerator and performing a defrost operation according to the detected number of rotations.

FIG. 1 is a circuit diagram of a conventional refrigerator defrosting apparatus, in which a first defrost sensing circuit 12 detects the temperature of an evaporator (not shown) to sense the frost formed on the evaporator using a first defrost sensor 11. A controller 15 accumulates defrost entering times from the temperature detected by the first defrost sensing circuit 12 to generate a defrost control signal, and generates an alarm control signal according to a temperature detected by a second defrost sensing circuit 14. A heater drive and display portion 17 drives first and second light emitting diodes LED1 and LED2 by means of a driver 16 according to the defrost control signal generated from the controller 15, and controls a relay switch RY_SW to drive first and second defrost heaters H1 and H2 via a relay RY. The second defrost sensing circuit 14 detects the temperature of the evaporator using a second defrost sensor 13 to sense the frost which is not removed during the defrost operation. An alarming portion 18 alarms a defrost state using a buzzer BZ according to the alarm control signal generated from the controller 15.

FIG. 2 is a flowchart of a procedure for illustrating a defrost controlling method of the refrigerator defrosting apparatus shown in FIG. 1, which is performed by the controller 15. In step S211, a cooling operation is performed by driving a compressor (not shown). In step S212, the operating time of the compressor in the step S211 is accumulated. In step S213, it is determined whether the operating time accumulated in the step S212 reaches a predetermined defrost entering time, i.e., a first reference value. In step S214, if the compressor operating time is a first reference value, the driving of the compressor is stopped. If not, the procedure returns to step S211. After performing step S214, the controller 15 outputs the defrost control signal to remove the frost formed on the evaporator by the defrost heater in step S215. In step S216, the number of defrost operations performed in step S215 is counted. In step S217, it is determined whether the counted number of defrost operations reaches a predetermined number, i.e., a second reference value. In step S218, it is determined whether the detected temperature of the first defrost sensor 11 is a defrost-off temperature in case that the counted number of defrost operations is not the second reference value in step S217, and steps S216 through S218 are repeatedly performed until the detected temperature of the first defrost sensor 11 reaches the defrost-off temperature. If the detected temperature of the first defrost sensor 11 reaches the defrost-off temperature, in step S219, it is determined whether the detected temperature of the first defrost sensor 11 and that of the second defrost sensor 13 equals to each other and steps S216 through S219 are repeatedly performed until the temperatures become equal to each other. In step S220, it is determined whether the detected temperature of the second defrost sensor 13 is a defrost-off temperature in case that the counted number of defrost operations is the second reference value in step 217. Step S220 is repeatedly performed until the temperature of the second defrost sensor 13 reaches the defrost-off temperature. If the temperature of the second defrost sensor 13 reaches the defrost-off temperature, in step S221, the number of accumulated defrost operations is cleared, and the defrost operation is suspended by stopping the driving of the defrost heater in step S222. Then, the routine goes back to step S211.

In the conventional refrigerator defrosting apparatus having the aforementioned configuration, the defrost operation for removing the frost formed on an evaporator is performed by the number of times set according to the temperature detected by a first defrost sensor. If the temperature of a second defrost sensor is not a defrost-off temperature even after the predetermined number of defrost operations are performed, the defrost operation is continuously performed while alarming that the defrost operation is being performed, thereby removing the frost which is not removed from the evaporator.

However, according to the above-described conventional refrigerator defrost controlling method, irrespective of the amount of the frost formed on the evaporator, the defrost operation is performed according to accumulation of the operating time of a compressor. Thus, in the case when the frost is excessively formed due to wet load of a refrigerator, the defrost operation is performed inefficiently. As a result, the cooling efficiency of the refrigerator is lowered, which increases power consumption.

SUMMARY OF THE INVENTION

To solve the above problems, it is an object of the present invention to provide a refrigerator defrost controlling method for determining the amount of the frost formed on an evaporator by detecting a latent heat period obtained by a change in temperatures of a defrost sensor and controlling a defrost cycle and a defrost restoration temperature accordingly, so that the frost formed on an evaporator is completely removed by achieving an optimal defrost operation.

To achieve the above object, there is provided a refrigerator defrost controlling method comprising the steps of: a) setting an initial defrost cycle; b) determining whether defrost entering conditions are met; c) driving a defrost heater to remove the frost formed on the evaporator if the defrost entering conditions are met in the step b), and setting a defrost restoration temperature and defrost cycle according to a latent heat period detected by the temperature of a defrost sensor to perform the defrost operation; d) terminating the defrost operation if the temperature of the defrost sensor reaches the defrost restoration temperature, and going back to the step b); and e) resetting a defrost cycle according to the operating rate of a compressor and the number of door opening/closing times if the defrost entering conditions are not met in the step b), and then returning to the step b).

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

Hereinbelow, a refrigerator defrost controlling method according to a preferred embodiment of the present invention will be described with reference to the accompanying drawings.

Figure 1:
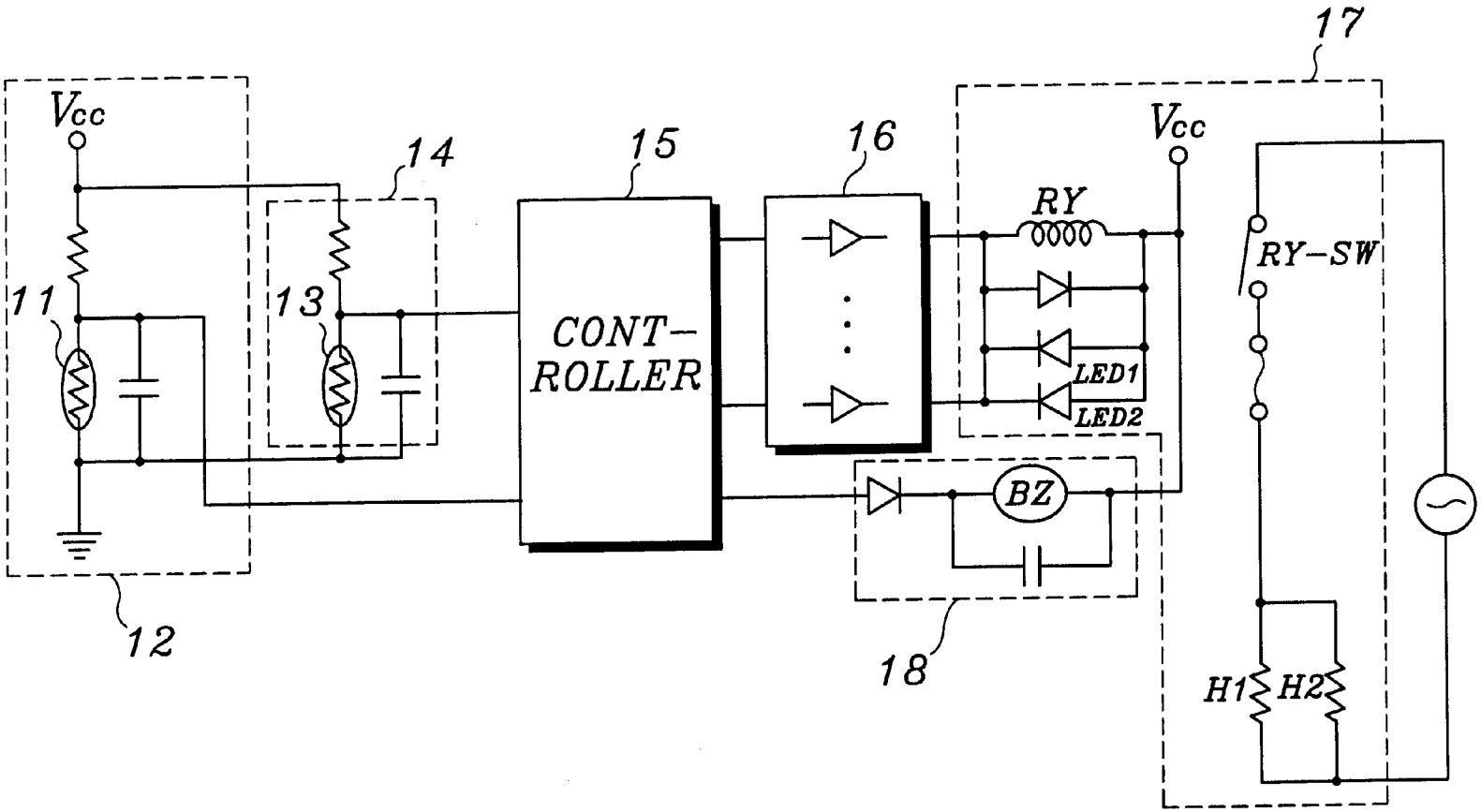
FIG. 1 (PRIOR ART)
FIG. 1 is a circuit diagram schematically showing a conventional refrigerator defrosting apparatus.
Figure 2A:
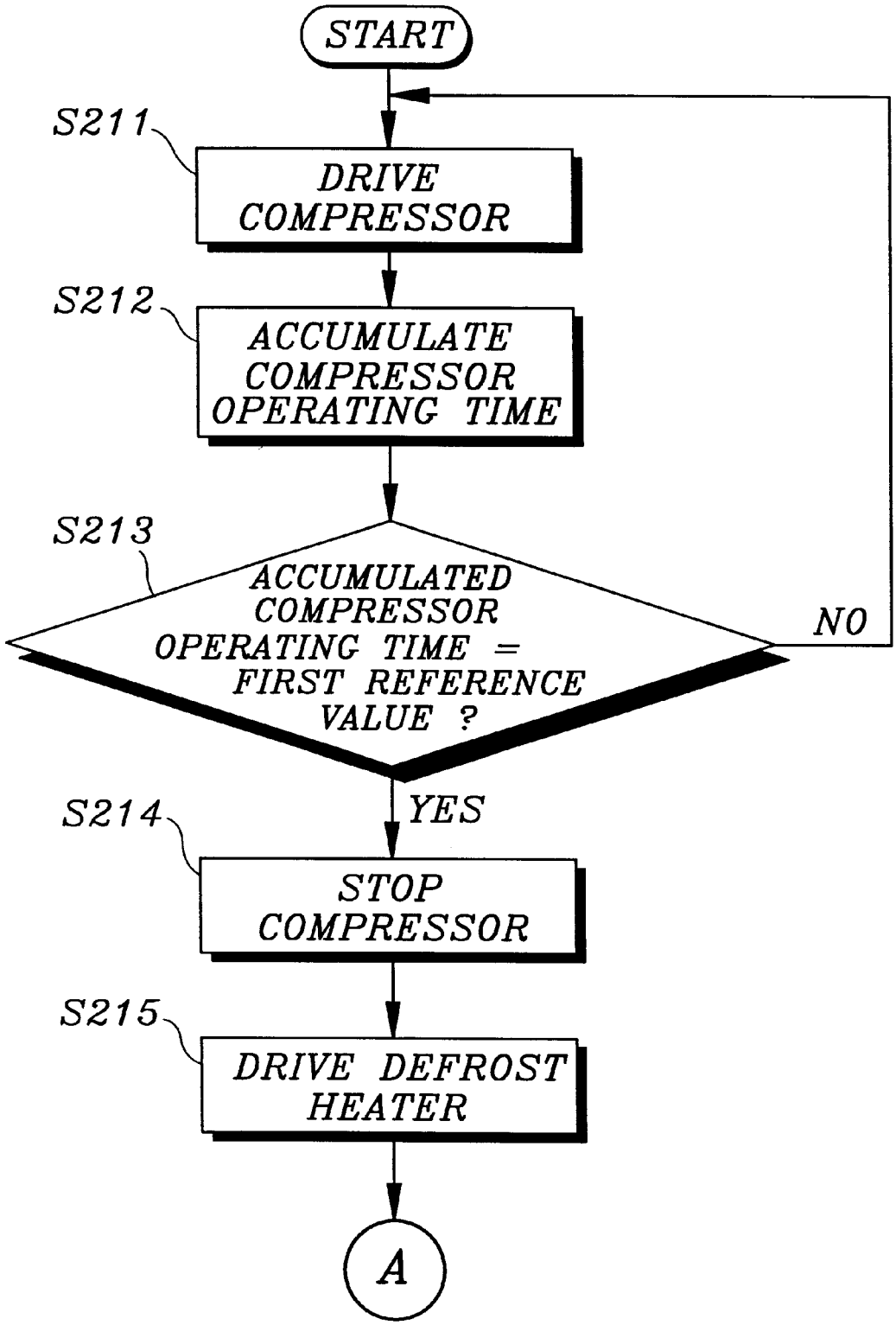
FIG. 2A (PRIOR ART)
FIGS. 2A and 2B are flowcharts of a procedure illustrating a refrigerator defrost controlling method of the apparatus shown in FIG. 1.
Figure 2B:
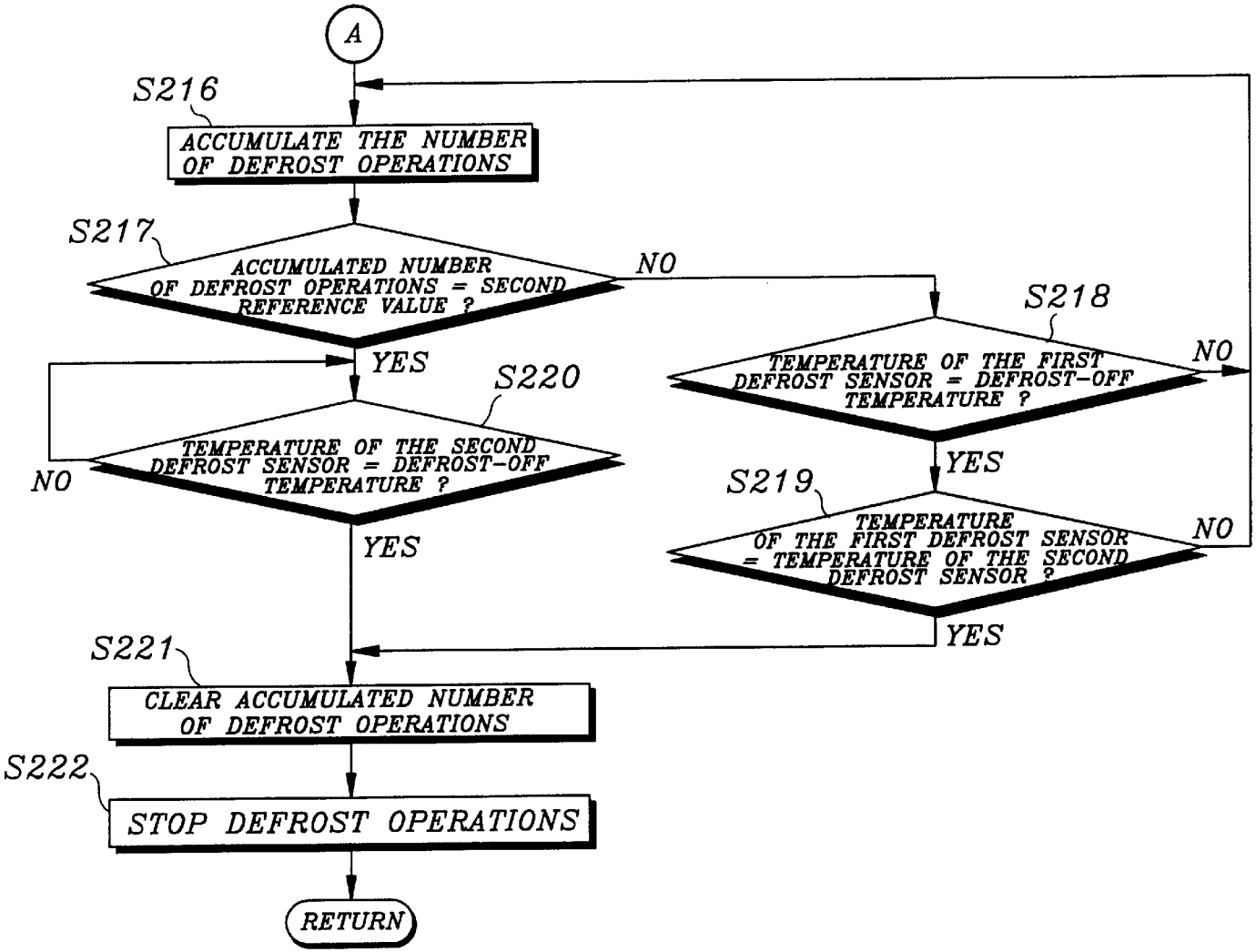
FIG. 2B (PRIOR ART)
Figure 3:
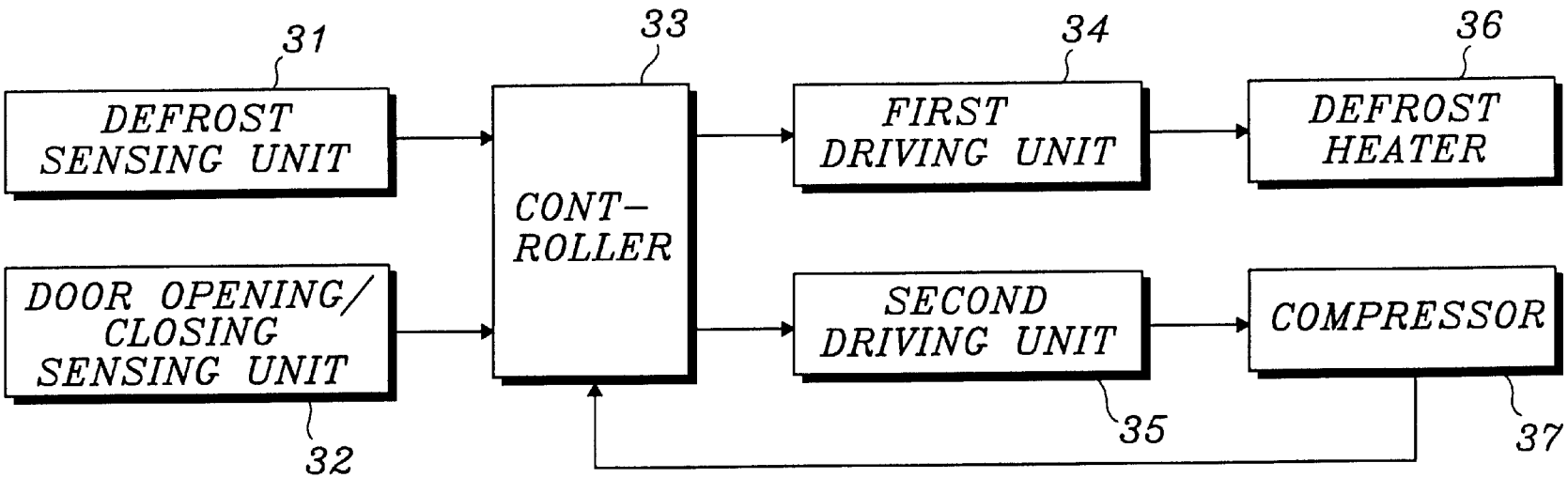
FIG. 3 is a schematic block diagram of a refrigerator defrosting apparatus for implementing a defrost controlling method according to the present invention.

FIG. 3 is a schematic block diagram of a refrigerator defrosting apparatus for implementing a defrost controlling method according to the present invention. The refrigerator defrost apparatus includes a defrost sensing unit 31 for sensing the frost formed on an evaporator (not shown) from the temperature detected by a defrost sensor (not shown), a door opening/closing sensing unit 32 for sensing door opening or closing of a freezer compartment in a refrigerator, a controller 33 for obtaining a defrost cycle from the temperature detected by the defrost sensing unit 31 to generate a defrost control signal, and first and second drivers 34 and 35 for driving a defrost heater 36 and a compressor 37 according to the defrost control signal generated from the controller 33, respectively.

Figure 4:
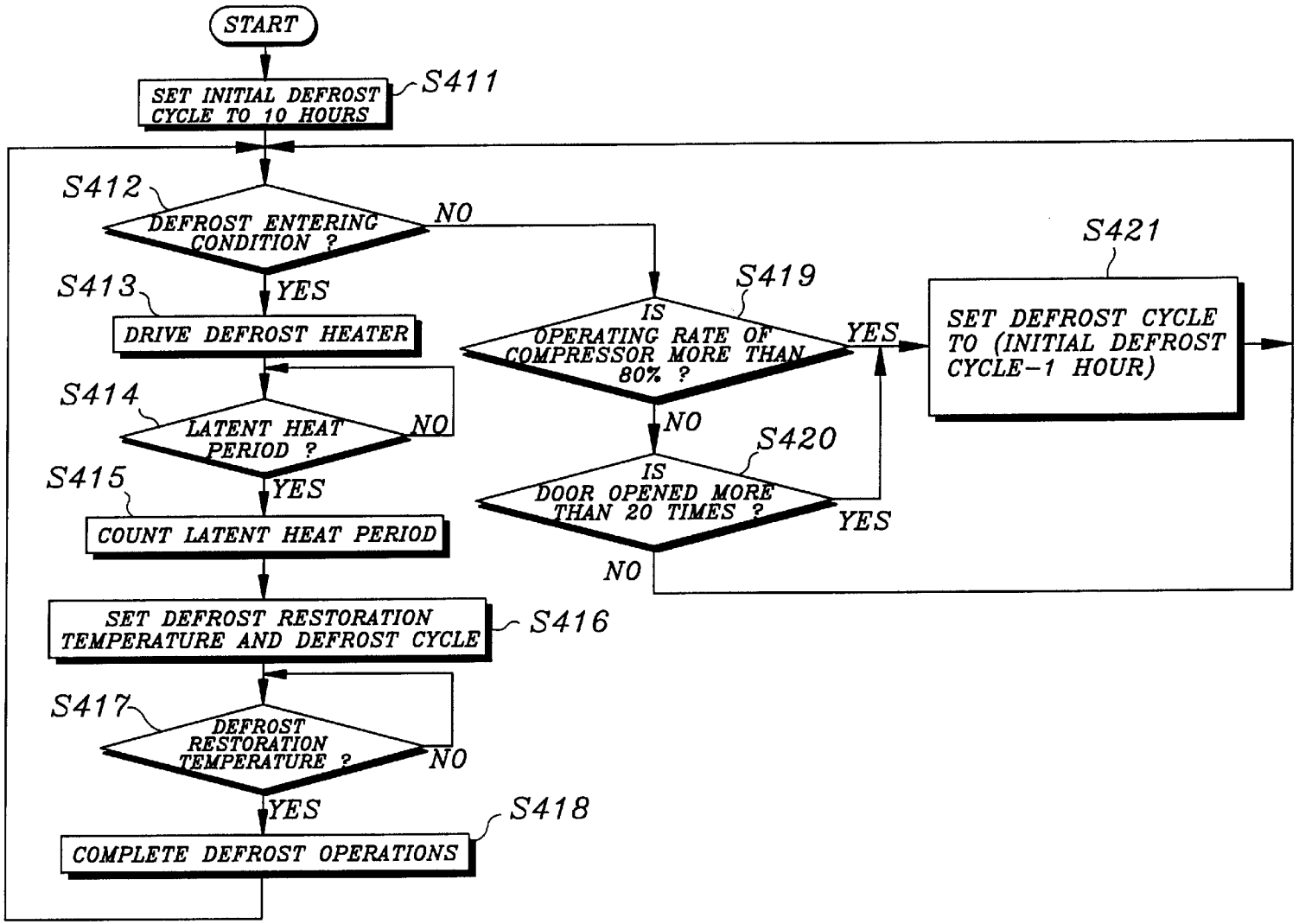
FIG. 4 is a flowchart of a procedure illustrating a refrigerator defrost controlling method according to the present invention.

FIG. 4 is a flowchart of a procedure illustrating a refrigerator defrost controlling method according to the present invention. In step S411, an initial defrost cycle is set. In step S412, it is determined whether a defrost entering condition is met, that is, the set defrost cycle is reached. If the defrost entering condition is met, while performing a defrost operation, the defrost cycle and defrost restoration temperature are reset according to the length of the latent heat period detected by a change in temperature of the defrost sensor (steps S413 through S416). If the defrost entering condition is not met, the defrost cycle is reset according to the operating rate of a compressor (not shown) and the number of door opening/closing times to perform the defrost operation, and then the routine goes back to step S412 (steps S419 through S421). Then, it is determined whether the temperature detected by the defrost sensor is the defrost restoration temperature, and the routine goes back to step S412 (steps S417 and S418).

Figure 5A:
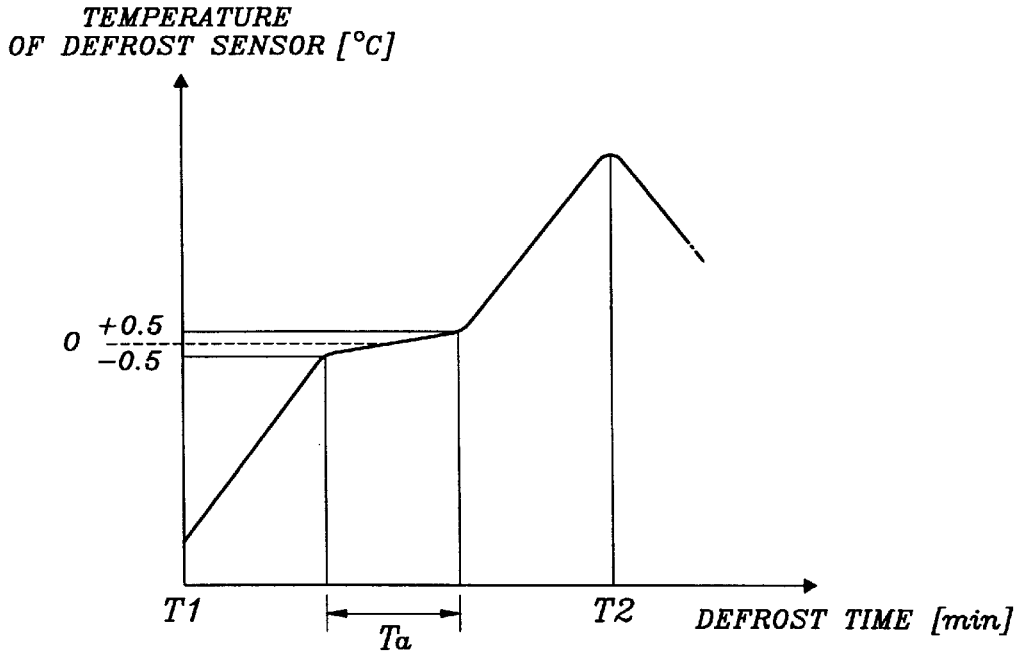
FIG. 5A is a graph illustrating a latent heat period obtained by a change in temperatures of a defrost sensor.
Figure 5B:
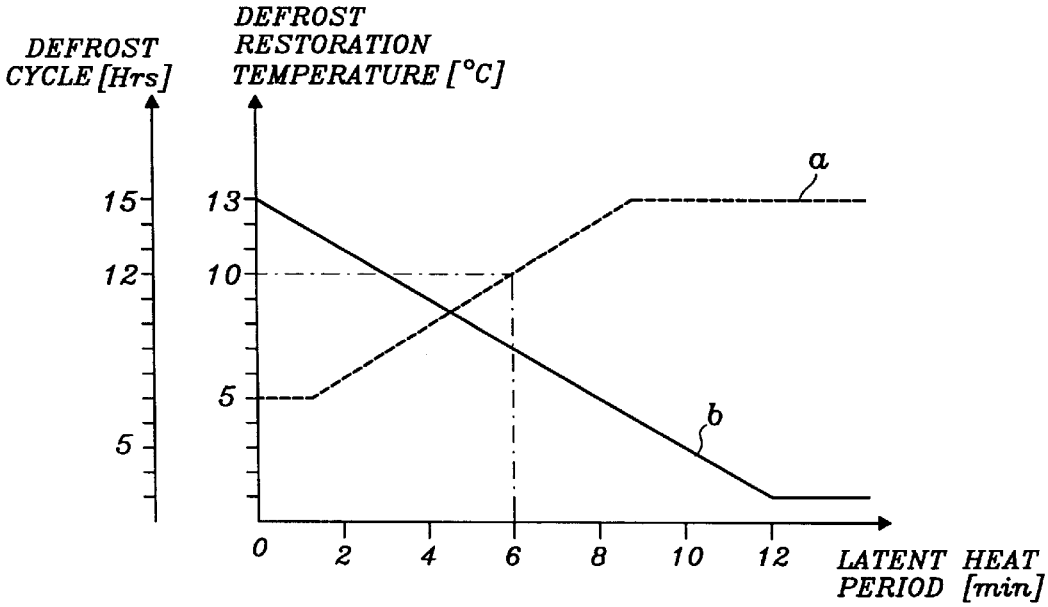
FIG. 5B is a graph illustrating the defrost restoration temperature (a) and defrost cycle (b) depending on the latent heat period.

FIG. 5A is a graph illustrating a latent heat period obtained by a change in temperatures of a defrost sensor, in which T1 denotes a defrost starting point, Ta denotes a latent heat period, and T2 denotes a defrost terminating point, respectively. The latent heat of pure water is at a temperature of 0° C. However, since the water on the evaporator is not pure water, in the present invention, the latent heat period Ta is set to be in the range of 0° C. ±0.5° C. Here, ±0.5° C. is variable according to experiments. FIG. 5B is a graph illustrating the defrost restoration temperature (a) and defrost cycle (b) depending on the latent heat period, in which the defrost restoration temperature (a) is substantially proportional to the length of the latent heat period Ta and the defrost cycle (b) is substantially inversely proportional to the length of the latent heat period Ta.

The refrigerator defrost controlling method according to the present invention will be described in more detail with reference to FIGS. 3, 4, 5A and 5B.

First, in step S411, the initial defrost cycle is set according to the operating rate of a compressor 37, for example, 10 hours. In step S412, it is determined whether a defrost entering condition is met, according as it is determined whether the initial defrost cycle or the reset defrost cycle is elapsed from the timing of the previous defrost terminating operation. If the determination result in step S412 corresponds to the defrost entering condition, the defrost heater 36 is driven for a predetermined time to start to remove the frost formed on an evaporator (not shown) in step S413.

In step 414, according to a change in temperature of a defrost sensor (not shown), as shown in FIG. 5A, it is determined whether the current temperature detected by the defrost sensor corresponds to the latent heat period Ta. If the detected temperature corresponds to the latent heat period Ta, the latent heat period is counted by measuring the starting and termination points to obtain the length of the latent heat period in step S415. In step S416, the defrost cycle and defrost restoration temperature are reset according to the length of the latent heat period Ta obtained in step S415. That is to say, if the latent heat period Ta is longer than that of normal conditions, it is determined that the amount of the frost formed on the evaporator is larger than that of normal conditions, and then the defrost restoration temperature is set high to increase the defrost time and shorten the defrost cycle. For example, as shown in FIG. 5B, if the latent heat period Ta lasts for 6 minutes, the defrost cycle, that is, the time from the starting timing of the current defrost operation to that of the next defrost operation, is set to 12 hours. Here, the defrost restoration temperature becomes 10° C. On the other hand, if the latent heat period is shorter than that of normal conditions, it is determined that the amount of the frost formed on the evaporator is smaller than that of normal conditions, and then the defrost restoration temperature is set low to decrease the defrost time and prolong the defrost cycle.

In step S417, it is determined whether the temperature detected by the defrost sensor is the defrost restoration temperature. If the defrost restoration temperature is reached, it is determined in step S418 that the defrost operation is completed, to then operate the refrigerator normally.

If the defrost entering condition is not met in step S412, it is determined that the operating rate of the compressor 37 is greater than 80%, for example, in step 419. If the operating rate of the compressor 37 is greater than 80%, the defrost cycle is reset to 9 hours one hour, for example, less than the initial defrost cycle set in step S411 (step S421), and then the routine goes back to step S412.

Also, if the operating rate of the compressor 37 is less than 80% in step S419, it is determined whether the door is opened more than 20 times, for example, in step S420. If the door is opened more than 20 times, the defrost cycle is reset to 9 hours one hour, for example, less than the initial defrost cycle set in step S411 (step S421), and then the routine goes back to step S412. If the operating rate of the compressor 37 is less than 80% and the door is opened less than 20 times, the routine goes back to step S412 and the above-described procedure is repeated.

As described above, in the refrigerator defrost controlling method according to the present invention, when removing the frost formed on an evaporator, the amount of the frost formed on the evaporator is determined from the latent heat period obtained by a change in temperature of a defrost sensor, and a defrost restoration temperature and a defrost cycle are adaptively reset accordingly, thereby performing the optimal defrost operation according to the amount of the formed frost. As a result, the frost overly formed on an evaporator due to wet load can be effectively removed, which increases a cooling efficiency of a refrigerator, thereby reducing power consumption.

Although the present invention has been described in detail herein with reference to illustrative embodiments, the invention is not limited thereto and various changes and modifications may be effected by one skilled in the art within the scope of the invention in consideration of the detailed description of the invention and the accompanying drawings.

What is claimed is:

1. A refrigerator defrost controlling method comprising the steps of:

a) setting an initial defrost cycle;

b) determining whether defrost entering conditions are met;

c) driving a defrost heater to remove the frost formed on an evaporator if the defrost entering conditions are met in said step b), and setting a defrost restoration temperature and a defrost cycle according to a latent heat period detected by the temperature of a defrost sensor to perform the defrost operation; and d) terminating the defrost operation if the temperature of the defrost sensor reaches the defrost restoration temperature, and going back to said step b).

2. The refrigerator defrost controlling method according to claim 1 further comprising the step of: e) resetting a defrost cycle according to the operating rate of a compressor and the number of door opening/closing if the defrost entering conditions are not met in said step b), and then returning to said step b).

3. The refrigerator defrost controlling method according to claim 2, wherein said step e) comprises the steps of:

e1) determining whether the operating rate of the compressor is greater than a first reference value in case that the defrost entering conditions are not met;

e2) determining whether the number of door opening/closing is greater than a second reference value in case that the operating rate of the compressor is less than the first reference value; and e3) resetting the defrost cycle if the operating rate of the compressor is greater than the first reference value or the number of door opening/closing is greater than the second reference value.

4. The refrigerator defrost controlling method according to claim 1, wherein the defrost restoration temperature in said step c) is set to be substantially proportional to the length of the latent heat period.

5. The refrigerator defrost controlling method according to claim 1, wherein the defrost cycle in said step c) is set to be substantially inversely proportional to the length of the latent heat period.

* * * * *